US005568133A

United States Patent [19]

Durrer et al.

[11] Patent Number: 5,568,133

[45] Date of Patent: Oct. 22, 1996

[54] FIRE ALARM

[75] Inventors: Bernhard Durrer, Wilen-Wollerau; Hans Botschi, Männedorf; Peter Gruber, Stäfa, all of Switzerland

[73] Assignee: Cerberus AG, Mannedorf, Switzerland

[21] Appl. No.: 570,814

[22] Filed: Dec. 12, 1995

Related U.S. Application Data

[63] Continuation-in-part of Ser. No. 205,578, Mar. 3, 1994, abandoned.

[30] Foreign Application Priority Data

Mar. 19, 1993 [CH] Switzerland ..... 846/93

[51] Int. Cl.[6] ..... G08B 23/00

[52] U.S. Cl. ..... 340/693; 206/459.5

[58] Field of Search ..... 340/693, 628–630; 206/807, 459.5, 305

[56] References Cited

U.S. PATENT DOCUMENTS

| | | | |
|---|---|---|---|
| 4,315,594 | 2/1982 | Niederöst | 340/693 |
| 4,881,063 | 11/1989 | Fawcett | 340/693 |
| 5,055,830 | 10/1991 | Cousins | 340/693 |

FOREIGN PATENT DOCUMENTS 9210858 10/1992 Germany .

*Primary Examiner*—Thomas Mullen

*Attorney, Agent, or Firm*—Brumbaugh, Graves, Donohue & Raymond

[57] ABSTRACT

Upon insertion of a fire alarm insert into a corresponding fire alarm mounting, the insert covers the mounting. The insert has a movable fastening comprising a ring, for example, for fastening the insert to the mounting. Indicator elements are included for indicating proper positioning of the insert relative to the mounting.

16 Claims, 3 Drawing Sheets

FIRE ALARM

This is a continuation-in-part of application Ser. No. 08/205,578, filed Mar. 3, 1994, abandoned.

BACKGROUND OF THE INVENTION

The invention relates to fire alarms or detectors, and to their installation.

As known for the protection of human life and material assets, fire alarms may be included in early-warning fire-alarm systems. Such a system typically includes a signaling and control center, and fire alarms distributed in the premises to be protected.

The fire alarms include fire sensors, electronic amplifiers, and means for communicating information to the signaling and control center. Typically, a fire alarm assembly consists of the fire alarm proper, called alarm insert, including one or several sensors with electronic circuitry, and of an alarm base or mounting which is permanently installed in the premises to be protected and into which the alarm insert is inserted. Thus, the alarm inserts can be removed for service and then reinserted.

Since fire alarm systems have to meet stringent reliability standards, weak spots must be eliminated to the extent possible. Undoubtedly in this regard, a reliable connection between the fire alarm insert and its base is required for dependable functioning of the fire alarm system. Reliability of connection depends on alarm design and is an important consideration in alarm development.

The following are among requirements to be met by the connection between the alarm base and the alarm insert: reliable electrical contact, protection of the contacts against contamination and corrosion, reliable mechanical attachment, and pleasing appearance. The latter requirement arises especially in surroundings where aesthetics play a role, e.g., in theaters, museums and historical buildings.

As a design which combines pleasing appearance with protection against contamination of contacts, German Patent Document DE-U1-9210858 discloses an alarm insert which completely covers the base upon insertion. Advantageously further in this design, discoloration of the base due to aging does not detract from the appearance of the alarm, e.g., upon later replacement of the alarm insert.

Alarms in accordance with German Patent Document DE-U1-9210858 suffer from a drawback in that, with the alarm base completely covered by the alarm insert, it is difficult to determine whether the insert has been properly inserted in the base. Proper insertion of the alarm in the base is a key condition for proper functioning, and improperly inserted alarms are sources of errors and of malfunctioning giving rise to complaints.

In the past, this shortcoming did not receive proper attention, until it was realized that proper positioning of alarms had to be verified by trained technicians. The attendant additional effort and costs of installation are unavoidable in the interest of functional integrity of the system.

SUMMARY OF THE INVENTION

In the interest of alleviating prior-art drawbacks as described, a preferred fire alarm insert has a fastening by which the insert is mechanically fastened to the base and which further indicates whether the insert is properly positioned relative to the base. Preferably, such indication is apparent to the human eye from a distance of several meters, for ready verification at minimum cost.

DETAILED DESCRIPTION OF THE PREFERRED EMBODIMENTS

Figure 1:
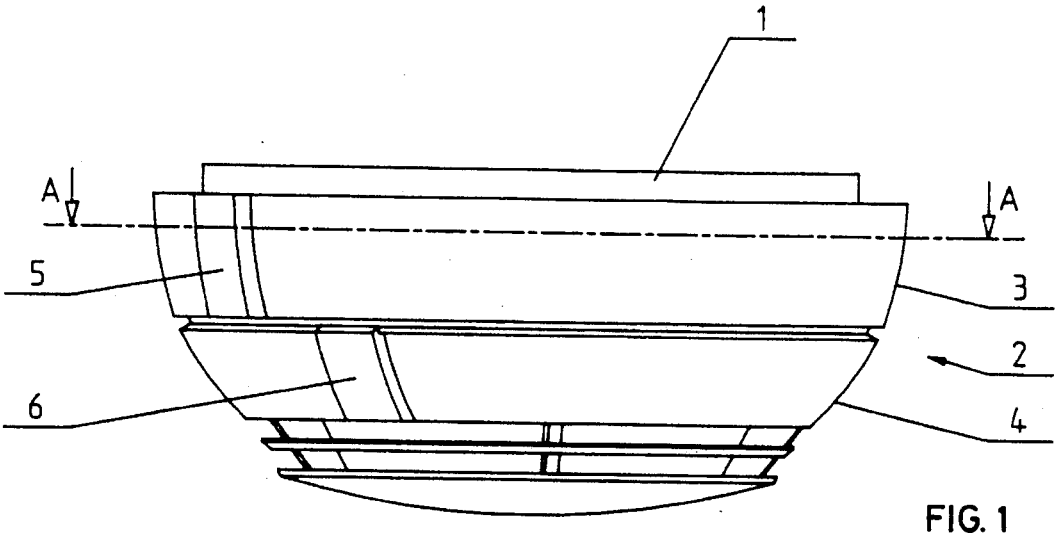
FIG. 1 is a side view of a preferred embodiment of a fire alarm in accordance with the invention, with the fastening unfastened.

FIG. 1 shows a fire alarm with a mounting 1 and an insert 2 consisting of a ring 3 and a lower portion 4, "lower" being understood as the fire alarm is shown mounted downward, without precluding different orientations. The ring 3 is movable through a delimited angular range relative to the lower part 4. The insert 2 is fastened to the mounting 1 by a fastening as described below. A first indicator element 5 is disposed at the outer surface of the ring 3, and a second indicator element is disposed at the outer surface of the lower part 4 of the insert 2 such that, in an unfastened condition of the fire alarm, the first indicator element 5 is clearly displaced from the second indicator element 6 by a characteristic angle.

Figure 2:
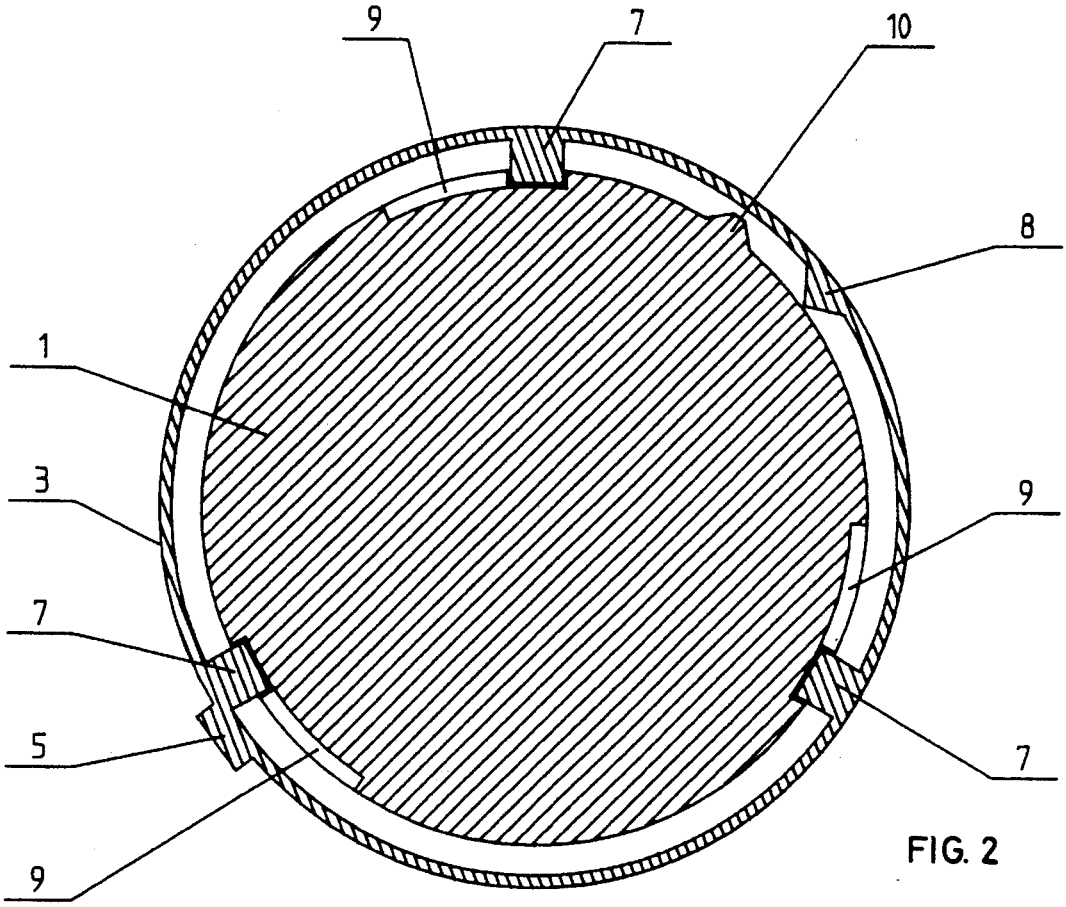
FIG. 2 is a cross section of the fire alarm of FIG. 1, at line A—A.
Figure 3:
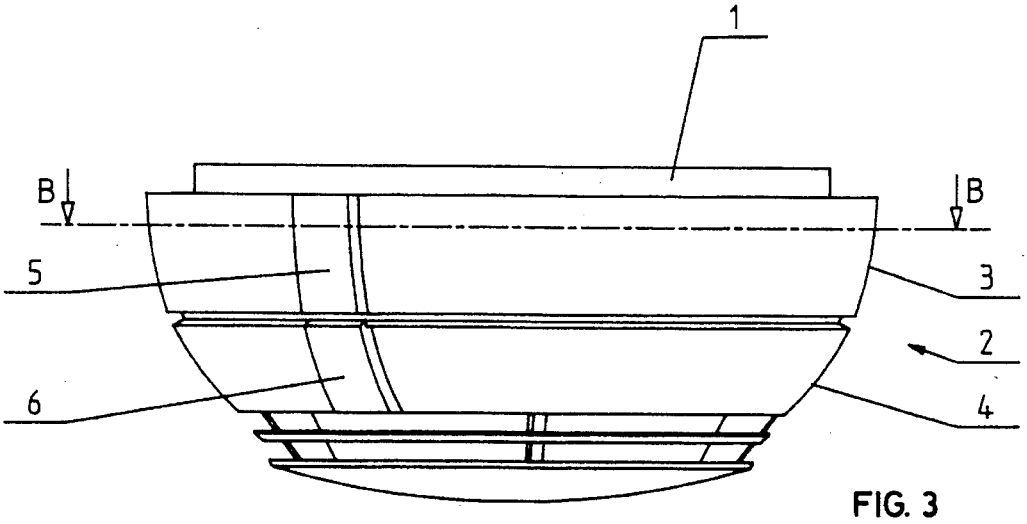
FIG. 3 is a side view of the fire alarm of FIG. 1, but with the fastening fastened.
Figure 4:
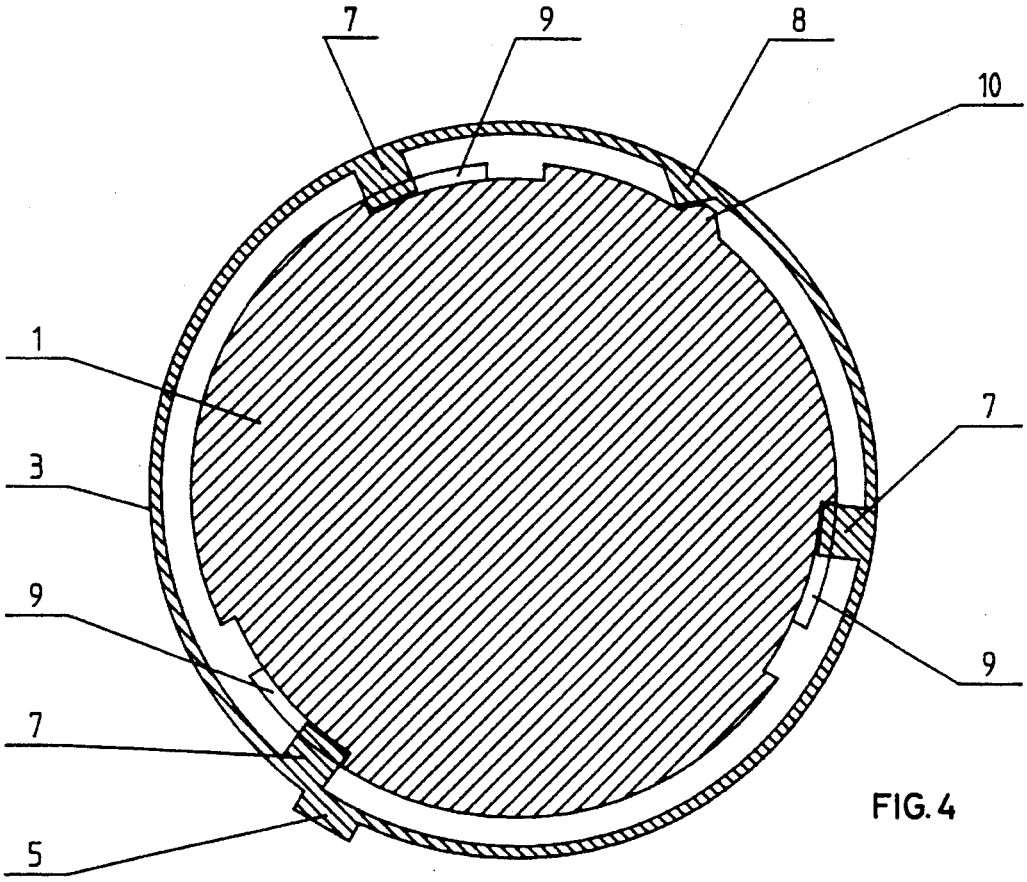
FIG. 4 is a cross section of the fire alarm of FIG. 3, at line B—B.

The fastening comprises three guide cams 7 and an arresting cam 8 disposed at the inner surface of the ring 3. The mounting 1 has three guide detents 9 in correspondence with the guide cams 7, and a retaining cam 10 in correspondence with the arresting cam 8. To fasten the insert 2 to the mounting 1 by means of the fastening, the insert 2 is first brought into a joining position with respect to the mounting 1, as shown in FIG. 2. To this end, the three guide cams 7 are inserted into the corresponding guide detents 9. The fastening is actuated upon rotation of the ring 3 relative to the lower part 4 through the characteristic angle, with the guide cams 7 moving along the guide detents 9 into the position shown in FIG. 4 while the lower part 4 remains rotationally fixed as shown by FIGS. 1 and 3. At the end of this movement, the arresting cam 8 passes the retaining cam 10. In this position, as shown in FIGS. 3 and 4, the first and second indicator elements 5 and 6 are aligned, so that complete and proper fastening is readily ascertainable from a distance of several meters, for example. Specific preferred embodiments may include raised and/or colored indicator elements.

Figure 5:
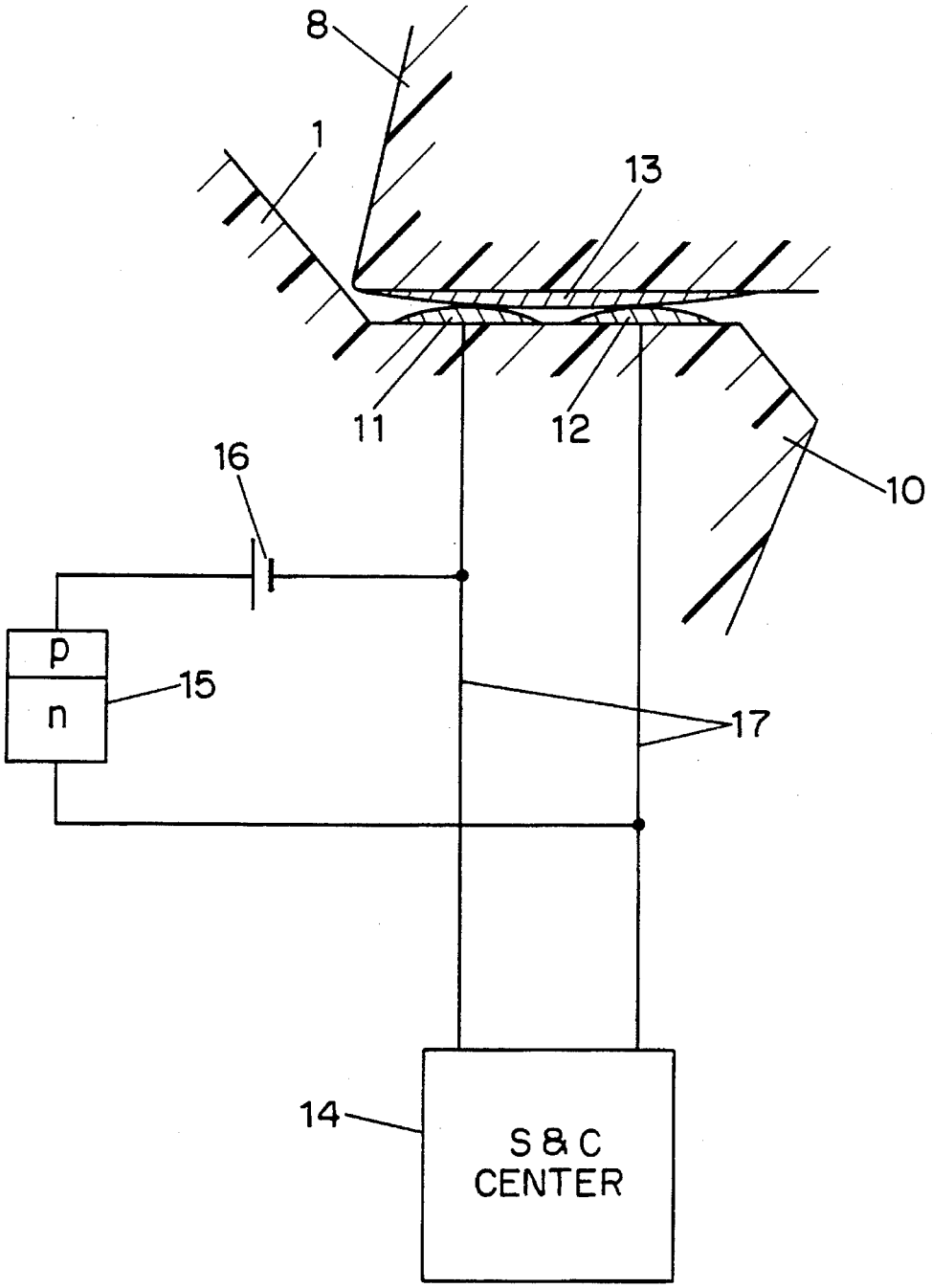
FIG. 5 is a schematic of an enlarged portion of FIG. 4, showing electrical and optical signaling means.

In addition to the mounting 1, ring 3, arresting cam 8 and retaining cam 10, FIG. 5 shows electrical contact elements 11 and 12 on the retaining cam and an electrical contact element 13 on the arresting cam. The contact elements 11 and 12 are connected to a signaling and control center 14, e.g., by electrical conductors 17, the connection providing an electrical signal upon proper fastening of the alarm insert. Proper fastening can be indicated also by a light source such as a light emitting diode 15 connected via a voltage source 16 to the contacts 11 and 12.

Other embodiments of the invention within the scope of the appended claims will be readily apparent to a person skilled in the art.

We claim:

1. A fire alarm comprising a mounting portion and an insert portion attached to the mounting portion, wherein the mounting portion comprises first fastener means, and wherein the insert portion comprises:

an insert part having a coupling end;

a fastener part rotatably coupled to the insert part at the coupling end of the insert part, and comprising second fastener means for engaging the first fastener means upon rotation of the fastener part relative to the insert part through a delimited angular range;

wherein the fastener part comprises a first indicator element whose rotational position relative to the insert part indicates whether the second fastener means properly engages the first fastener means.

2. The fire alarm in accordance with claim 1, wherein the fastener part further comprises a ring element, and wherein the first indicator element is disposed on the ring element.

3. The fire alarm in accordance with claim 2, further comprising a second indicator element which is disposed on the insert part such that the position of the ring element relative to the insert part is apparent upon visual inspection of the relative positions of the first and second indicator elements.

4. The fire alarm in accordance with claim 3, wherein at least one of the first and second indicator elements comprises a shaped indicator element.

5. The fire alarm in accordance with claim 3, wherein at least one of the first and second indicator elements is colored.

6. The fire alarm in accordance with claim 1, further comprising electrical contacts on the mounting portion, for signaling proper fastening of the insert portion.

7. The fire alarm in accordance with claim 6, further comprising signaling means connected to the electrical contacts for transmitting a signal indicating proper fastening to a signaling and control center.

8. The fire alarm in accordance with claim 6, wherein the indicator means further comprises means for producing an optical signal connected to the electrical contact means.

9. A fire alarm insert portion for attachment to a mounting portion having first fastener means, the insert portion comprising:

an insert part having a coupling end;

a fastener part rotatably coupled to the insert part at the coupling end of the insert part, and comprising second fastener means for engaging the first fastener means upon rotation of the fastener part relative to the insert part through a delimited angular range;

wherein the fastener part comprises a first indicator element whose rotational position relative to the insert part indicates whether the second fastener means properly engages the first fastener means.

10. The fire alarm insert portion in accordance with claim 9, wherein the fastener part further comprises a ring element, and wherein the first indicator element is disposed on the ring element.

11. The fire alarm insert portion in accordance with claim 10, further comprising a second indicator element which is disposed on the insert part such that the position of the ring element relative to the insert part is apparent upon visual inspection of the relative positions of the first and second indicator elements.

12. The fire alarm insert portion in accordance with claim 11, wherein at least one of the first and second indicator elements comprises a shaped indicator element.

13. The fire alarm insert portion in accordance with claim 11, wherein at least one of the first and second indicator elements is colored.

14. The fire alarm insert portion in accordance with claim 9, further comprising electrical contacts on the mounting portion, for signaling proper fastening of the insert portion.

15. The fire alarm insert portion in accordance with claim 14, further comprising signaling means connected to the electrical contacts for transmitting a signal indicating proper fastening to a signaling and control center.

16. The fire alarm insert portion in accordance with claim 14, wherein the indicator means further comprises means for producing an optical signal connected to the electrical contact means.

* * * * *